US005997240A

United States Patent [19]

Focke et al.

[11] Patent Number: 5,997,240

[45] Date of Patent: Dec. 7, 1999

[54] DEVICE FOR HANDLING STACKS OF BLANKS

[75] Inventors: Heinz Focke, Verden; Pavel Livotov, Hannover; Frank Hill, Bremen, all of Germany

[73] Assignee: Focke & Co. (GmbH & CO.), Verden, Germany

[21] Appl. No.: 08/985,294

[22] Filed: Dec. 4, 1997

[30] Foreign Application Priority Data

Dec. 6, 1996 [DE] Germany ..... 196 50 689

[51] Int. Cl.[6] ..... B65G 61/00

[52] U.S. Cl. ..... 414/797; 198/347.3; 901/16

[58] Field of Search ..... 414/796.2, 796.9, 414/797; 198/347.3; 901/16

[56] References Cited

U.S. PATENT DOCUMENTS 4,242,025 12/1980 Thibault ..... 901/16
4,571,149 2/1986 Soroka et al. ..... 901/16
4,911,608 3/1990 Krappitz et al. ..... 414/796.9
5,038,909 8/1991 Covert ..... 198/347.3
5,074,745 12/1991 Neri ..... 414/796.9
5,190,430 3/1993 Neri et al. ..... 414/796.9
5,328,322 7/1994 Neri ..... 414/800

*Primary Examiner*—Christopher P. Ellis
*Assistant Examiner*—Gregory A. Morse
*Attorney, Agent, or Firm*—Sughrue, Mion, Zinn, Macpeak & Seas, PLLC

[57] ABSTRACT

Stacks of blanks (10) comprising a largish number of pre-fabricated blanks made of (thin) cardboard are usually made available on pallets (12). The stacks of blanks (10), provided if necessary with a band label (11), are aligned on the pallet (12) in rows (13) and disposed in a plurality of layers (16) the one above the other. A pick-up head (18) serves to unload the stacks and is movable on a support structure (19), configured like a portal, in a vertical and in a horizontal direction. The pick-up head (18) grasps respectively one group of stacks of blanks (10) and sets same down on an onward conveyor (14).

23 Claims, 5 Drawing Sheets

DEVICE FOR HANDLING STACKS OF BLANKS

BACKGROUND OF THE INVENTION

The invention relates to a device for picking up and transporting onwards stacks of packaging blanks arranged the one above the other, especially for the manufacture of cigarette packets of the hinge-lid type, a plurality of stacks of blanks being positioned in rows beside one another on a base, especially on a pallet, and layers, formed preferably of a plurality of rows, being disposed above one another, which may be grasped either individually or in groups by a pick-up head and may be set down on an onward conveyor leading to a packaging machine or the like.

Blanks made of (thin) cardboard, for the manufacture of cigarette packets in particular, are generally made available to the packaging machine as stacks of blanks. The blanks are predominantly delivered on pallets, aligned in parallel rows and in layers which are aligned in parallel rows and in layers which are arranged the one above the other and which are separated from one another by thin intermediate layers. Emptying the pallet and transferring the stacks of blanks to the packaging machine, especially to blanks magazines of same, is supposed to take place automatically, i.e. entirely by machine.

The purpose underlying the invention, therefore, is to propose a device which is suitable for grasping in succession, either individually or in groups, stacks of blanks and transferring them to an onward conveyor.

In fulfilment of this purpose, the device according to the invention is characterised in that the pick-up head may be moved, on the one hand by a telescoping member in a horizontal plane, especially in the conveying direction of the onward conveyor, and on the other hand along a crossrail running horizontally, backwards and forwards transversely to the conveying direction of the onward conveyor, and also up and down.

With a pick-up head which may be moved in the above sense, each region of the layer surface of the stacks of blanks can be approached, in order to grasp at least one stack of blanks, preferably, however, a plurality of stacks of blanks lying beside one another, and lead them towards the onward conveyor running at the side beside the pallet.

The lifting or pick-up head for the stacks of blanks is here movably mounted on a fixed support structure which consists of three upright posts. The latter are so arranged that two posts, disposed on the one side of the pallet, are connected to one another by an upper transverse bar. The third post, positioned on the opposite side of the pallet or on the outer side of the onward conveyor, is connected, via the crossrail which joins at the upper end, with the transverse bar of the posts lying opposite. The pick-up head, which may be moved on the underside of the crossrail, can therefore be driven out of a position above the stacks of blanks into a position above the onward conveyor.

The onward conveyor is also configured in a special way according to the invention. This conveyor has an interim store which preferably consists of a storage conveyor arranged above the onward conveyor.

In addition, according to the invention, a collecting vessel is provided for (thin) intermediate layers.

Further details of the invention relate to the design of the supporting framework for the pick-up head, to control units for the latter, and to the design of the onward conveyor and of the collecting vessel.

An embodiment of the invention, given by way of example, is explained in greater detail below with the aid of the drawings. These show:

DESCRIPTION OF A PREFERRED EMBODIMENT

Figure 1:
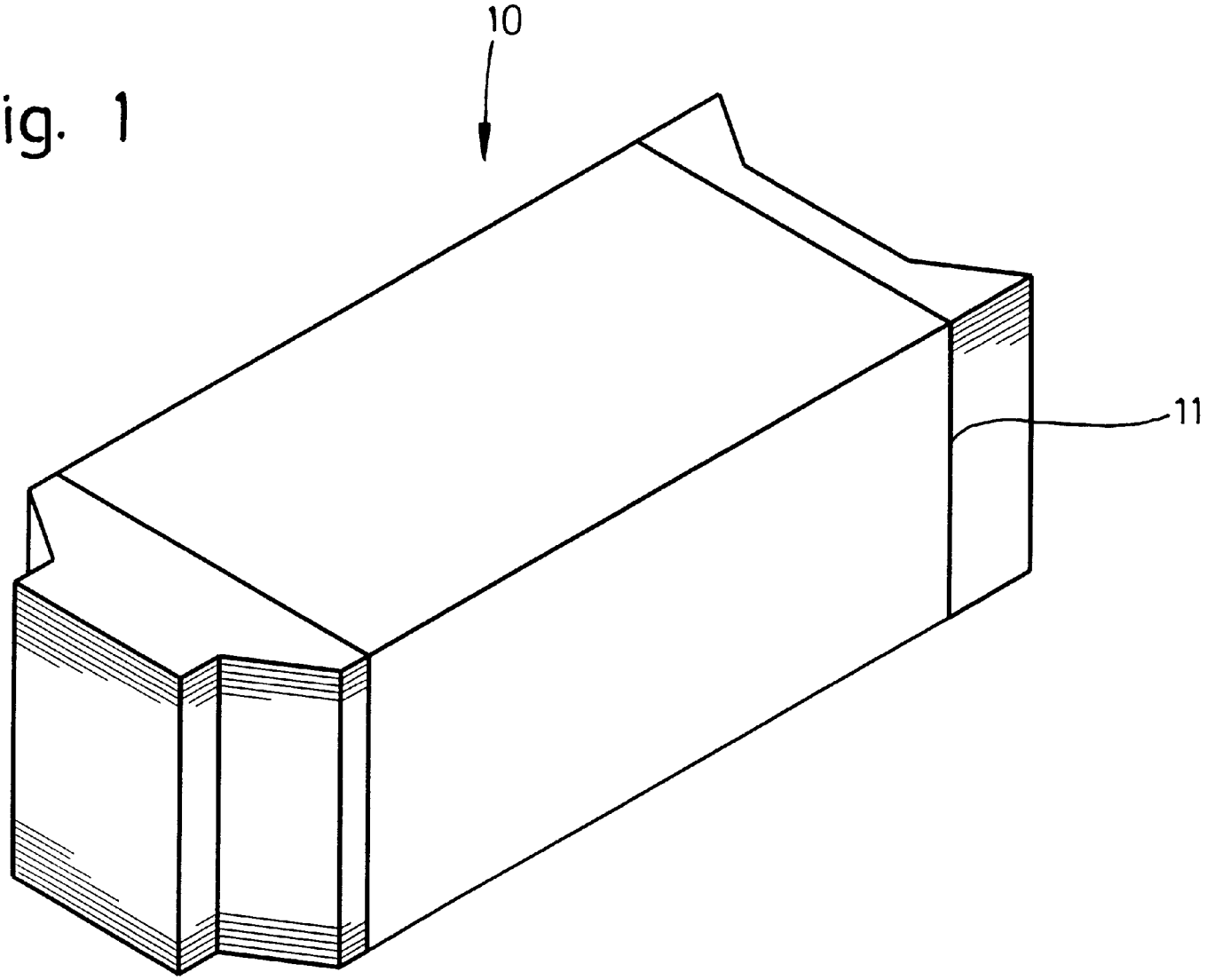
FIG. 1 an example of a stack of blanks, in perspective view.

The embodiment shown in the drawings relates to the preferred field of application, namely to the handling of stacks of blanks 10 made of thin cardboard for the manufacture of cigarette packets of the hinge-lid type. Blanks for a cigarette packet of this type have a special contour, as can be seen from FIG. 1. The stacks of blanks 10 are in this example surrounded by a band label 11. The latter is split and removed before the blanks are processed, in particular before the stacks of blanks 10 are led into a blanks magazine of a packaging machine (not shown).

The stacks of blanks 10 are made available on a pallet 12. The stacks of blanks 10 are here positioned in rows 13 on the pallet 12. The stacks of blanks 10 are aligned inside the rows of stacks 13. On the present example, the stacks of blanks 10 are disposed in a way to correspond to the onward transport of same by an onward conveyor 14. The stacks of blanks 10 are aligned on the latter with their longitudinal extension transverse to the direction of conveying (arrow 15).

Figure 2:
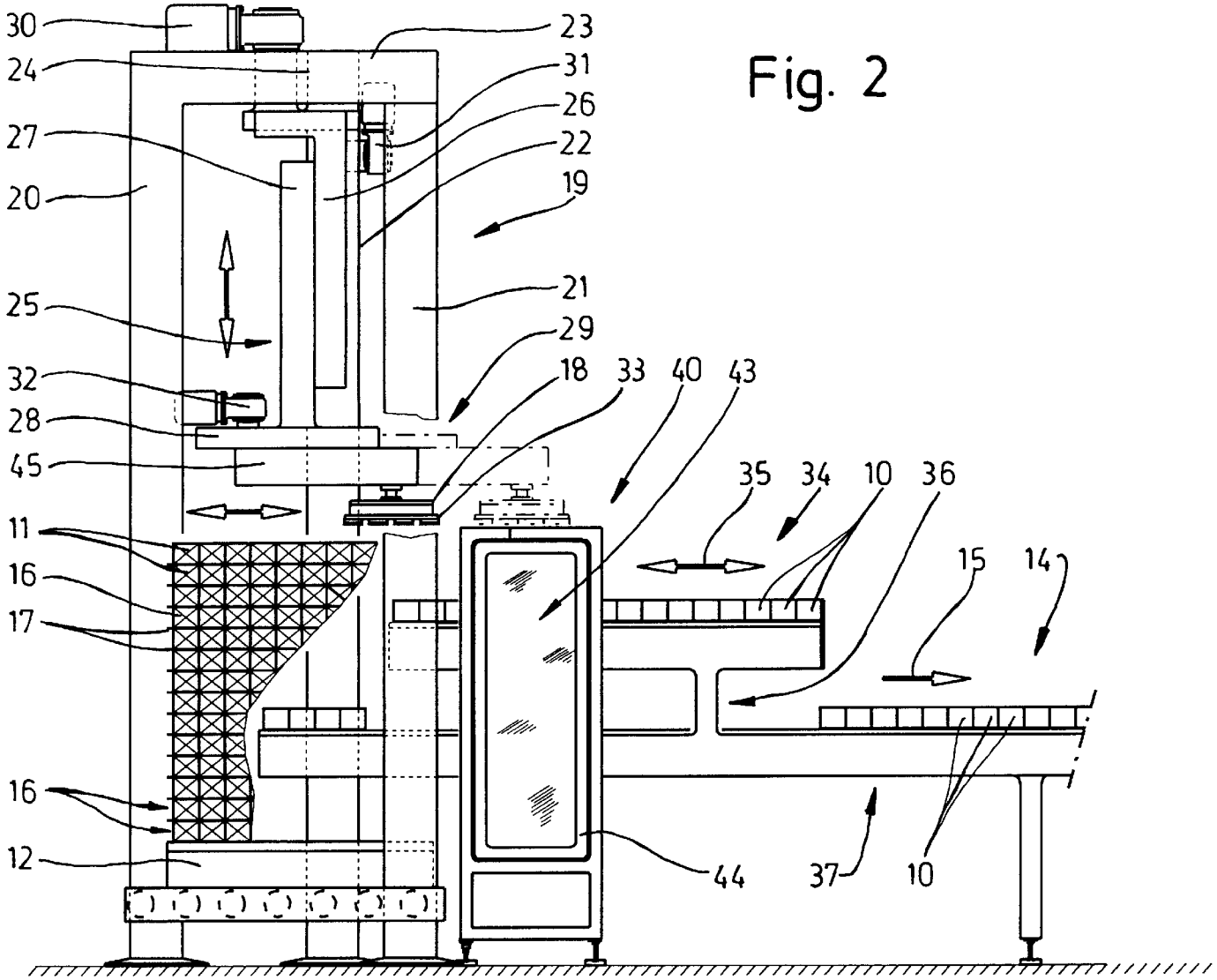
FIG. 2 a device for handling stacks of blanks, in side view.

A plurality of rows of stacks 13 lying beside one another forms a layer 16 made of stacks of blanks 10. As can be seen especially from FIG. 2, a largish number of layers 16 is stacked the one above the other. The neighbouring layers 16 are separated from one another by thin-walled intermediate layers 17 made of paper, foil or the like.

In order to supply the packaging machine with stacks of blanks 10, the latter are grasped in succession by a pick-up head 18, taken from the pallet 12 or the respective intermediate layer 17 and set down on the onward conveyor 14. In the present embodiment the pick-up head 18 is so configured that, per working cycle, a plurality of stacks of blanks 10, namely four, is grasped simultaneously beside one another and deposited without changing their relative position. The pick-up head 18 is expediently configured as a suction head which, with suction members 33 associated with each stack of blanks 10, grasps the stacks of blanks 10 on the upper side, especially in the region of the band labels 11.

The pick-up head 18 may be moved vertically and horizontally on a support structure 19 configured as a portal. The latter has three upright posts 20, 21, 22, which are positioned in a special way. Two posts 20, 21 are arranged on the free side of the pallet 12, beside same. These posts 20, 21 are connected to one another at their upper end by a transverse bar 23. The third post 22 is anchored on the opposite side of the pallet 12 or at the side beside the onward conveyor 14. The latter extends as far as directly into the region of the pallet 12, i.e. ends beside same. The individual post 22 is connected with an upper crossrail 24, running at the height of the transverse bar 23, with the transverse bar 23, and, on the basis of the spatial circumstances, in a plane offset from the centre in the direction of conveying as per arrow 15. The crossrail 24 accordingly extends off-centre above the pallet 12.

The pick-up head 18 may be moved on the underside of the crossrail 24 in the longitudinal direction of same, i.e. above the pallet 12 as well as above the onward conveyor 14. For up and down movements, a vertical telescopic member 25 is movably suspended on the underside of the crossrail 24. The vertical telescopic member 25 consists of an upper supporting section 26, which is connected to the crossrail 24 via moving gear, and of a lower supporting section 27. The latter is mounted on the upper supporting section 26 so as to be movable up and down. Through the up and down movement of the supporting section 27, the necessary vertical movements of the pick-up head 18 are effected.

Figure 4:
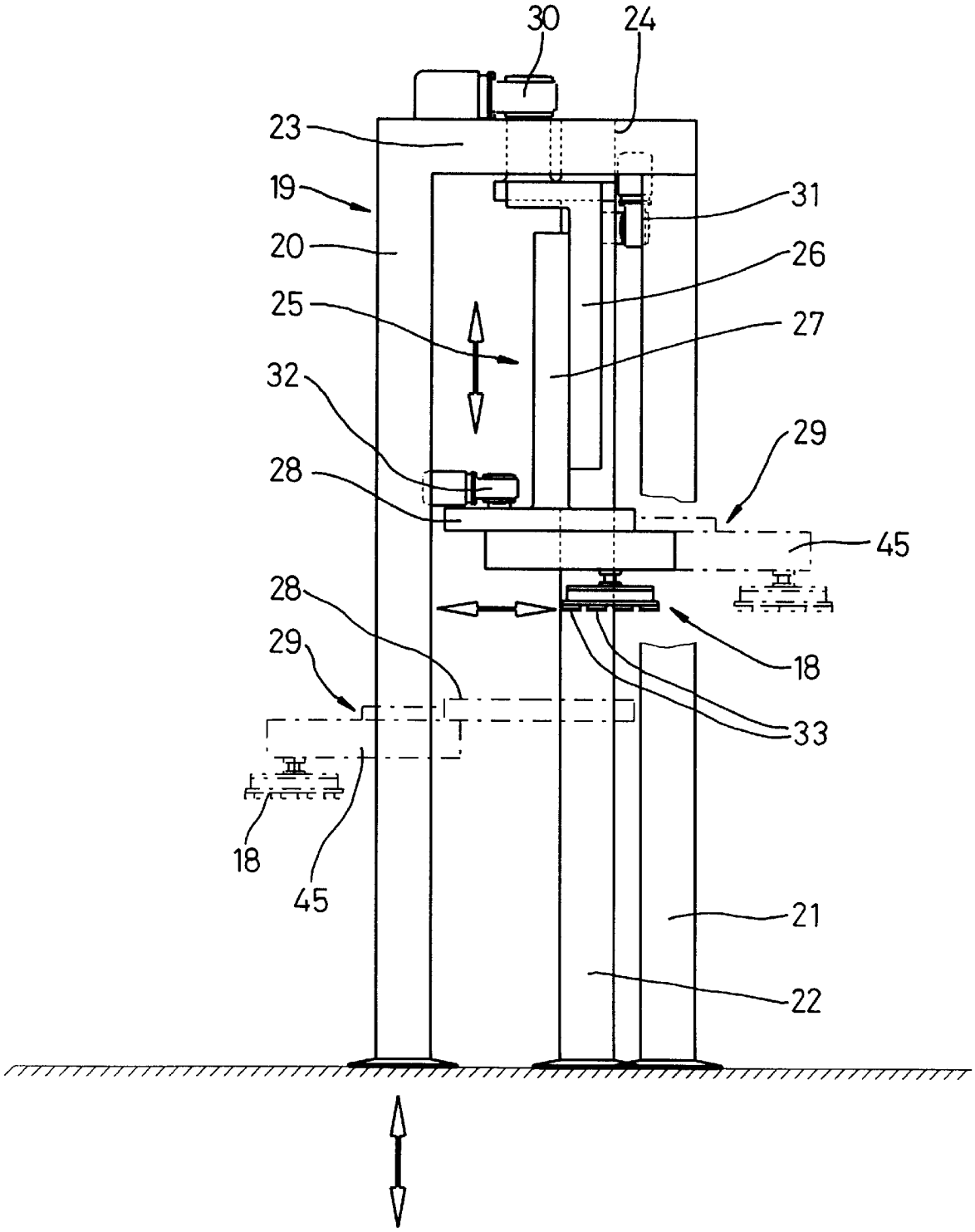
FIG. 4 a supporting framework for the pick-up head as a detail of FIG. 2, FIG. 5 an onward conveyor, configured in a special way, with a store, in side view.

At the lower end of the vertical telescopic member, on the supporting section 27 which may be moved up and down, there is located a carrier or a carrying plate 28 for the pick-up head 18 or for a horizontal telescopic member 29 to which the pick-up head 18 is attached. The horizontal telescopic member 29 may be driven in and out on the underside of the carrying plate 28 in a horizontal plane. The driven-out position is shown in dots and dashes in FIG. 4. The horizontal telescopic member 29 can, for example, be so configured that a carrying arm or supporting section 45 may be shifted with a section rail on the underside of the carrying plate 28 in the manner of a slide. The pick-up head 18 is attached to the underside of supporting section 45. In the present embodiment, given by way of example, the pick-up head 18 may also be moved in the longitudinal direction of the supporting section 45, producing an additional telescoping effect. The movements of the horizontal telescopic member 29 or of the pick-up head 18 extend parallel to the direction of conveying of the onward conveyor 14 as per arrow 15. As can be seen from FIG. 4, the horizontal telescopic member 29, or its supporting section 45, can be driven out in both directions, i.e. also against the conveying direction of the onward conveyor 14. The pick-up head 18 is preferably attached to the horizontal telescopic member 29 so as to be incapable of being twisted.

The movable members may be moved by (electric) motors. Beside the individual post 22, there is attached a driving motor 30 for the movements of the supporting framework for the pick-up head 18, namely of the vertical telescopic member 25 on the crossrail 24. A motor 31 for the movement of the vertical telescopic member 25 is attached at the side to the post 22.

Finally, a motor 32 for the horizontal telescopic member 29 is located on the carrying plate 28. This motor 32, on the basis of the corresponding configuration of its drive, causes both the inward and outward movement of the supporting section 45 and the relative movements of the pick-up head 18 on said supporting section 45.

Figure 3:
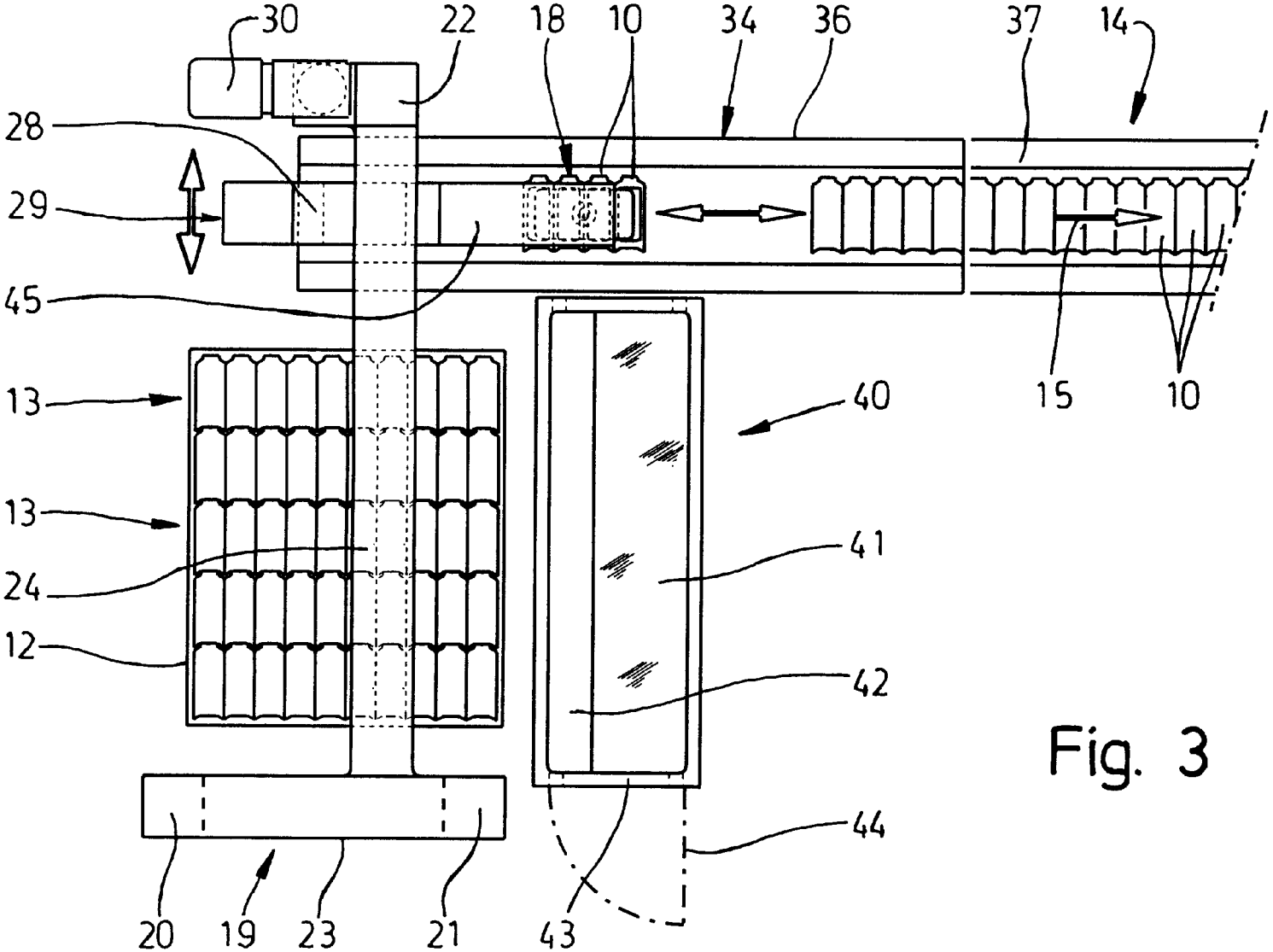
FIG. 3 the device according to FIG. 2, in horizontal projection.

In order to empty the pallet 12, the pick-up head 18 travels automatically into a position above the stacks of blanks 10 which are to be picked up. In the present example, the dimensions of the pick-up head 18 are such that four stacks of blanks 10 of one row 13 can be picked up by the pick-up head 18 in one working cycle, lying beside one another without altering their relative position. The pick-up head is equipped with a corresponding number of suction members 33, i.e. four, for grasping one stack of blanks each in the region of the band label 11. Without any rotary movement, the pick-up head 18 can be raised with the stack of blanks 10 and driven transversely. In a position above the onward conveyor 14 (FIG. 3), the pick-up head 18 is lowered until the stacks of blanks 10 lie on the onward conveyor 14—a belt conveyor. The pick-up head 18, on the one hand, and the onward conveyor 14, on the other hand, are expediently controlled in such a way that the respectively deposited group of stacks of blanks 10 joins on to the stacks of blanks 10 positioned in closely packed rows on the onward conveyor 14.

A further special characteristic of the device shown consists in the fact that an interim store 34 is provided for a number of stacks of blanks 10. The interim store 34 is, in the present case, likewise configured as a band store with a conveyor belt which may be moved in both directions, corresponding to arrow 35, and on which the stacks of blanks 10 rest. The interim store 34 is of such dimensions that at least the necessary time for exchanging an emptied pallet 12 for a new loaded one can be compensated for, in order to maintain a continuous row of stacks of blanks on the onward conveyor 14.

In the present embodiment, given by way of example, the interim store 34 is arranged above the onward conveyor 14. A support structure 36 of the interim store is connected to a support structure 37 of the onward conveyor 14, in such a way that onward conveyor 14 and interim store 34 lie above one another in the same plane. The onward conveyor 14 projects, with an end facing the pallet 12, beyond the interim store 34, with the result that a feeding end is created for laying the stacks of blanks 10 on to the onward conveyor 14.

Alternatively, the stacks of blanks 10 can be laid on the interim store 34.

Figure 5:
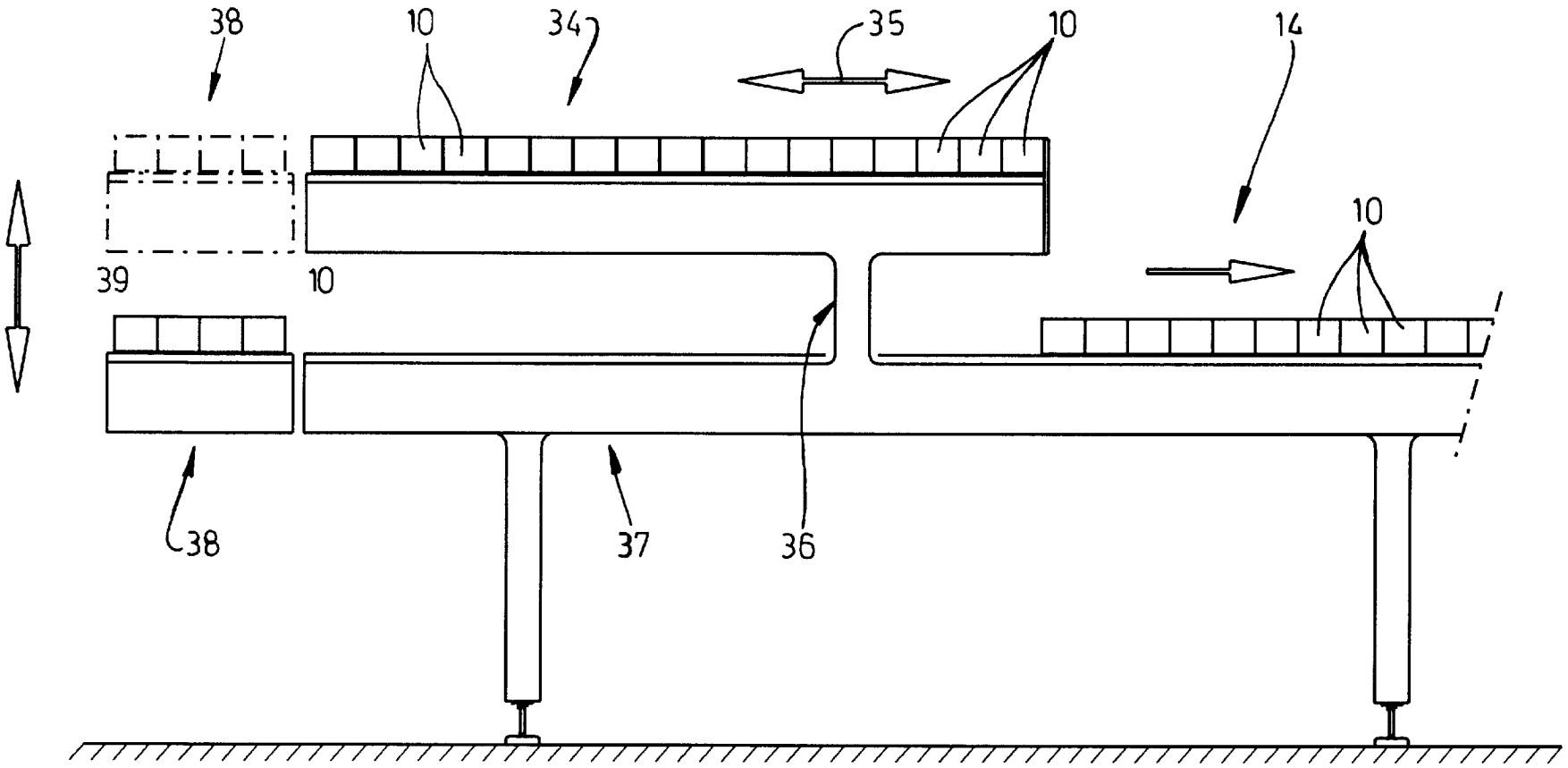

A further special characteristic arises from FIG. 5. An end region of the onward conveyor 14 is configured as a lifting conveyor 38. The latter is placed in its lower position in an extension to, or continuation of, the onward conveyor 14, in such a way that stacks of blanks 10 can be deposited in groups on the lifting conveyor 38 and then passed on from same to the onward conveyor 14.

The onward conveyor 14, the interim store 34 and the lifting conveyor 38 are preferably configured as belt conveyors. The stacks of blanks 10 lie transversely to the conveying direction on an upper hoistway of the respective belt conveyors. The belt of the onward conveyor 14 may expediently only be driven in one direction, whilst the belt of the interim store 34 and/or the belt of the lifting conveyor 38 may be driven in both movement directions.

The lifting conveyor 38 may be raised and lowered as per arrow 39. On this embodiment, the stacks of blanks 10 are basically set down from the pick-up head 18 on the lifting conveyor 38. If the interim store 34 is to be loaded, the lifting conveyor 38 is raised to the level of the interim store 34. The group of stacks of blanks 10 can then, in the upper position of the lifting conveyor 38, be transferred to the interim store 34.

Conversely, the lifting conveyor 38 can also be used for the return of stacks of blanks 10 from the interim store 34 to the onward conveyor 14. In this mode of operation, a group of stacks of blanks 10 is conveyed from the interim store 34 to the lifting conveyor 38 in its upper position. The lifting conveyor 38 is then lowered to the height of the onward conveyor 14. The stacks of blanks 10 can then be transferred to the latter.

A further theme of the embodiment, given by way of example and shown here, is the handling of the intermediate layers 17 disposed between the layers 16 of the stacks of blanks 10. Once a layer has been cleared away, the intermediate layer is grasped by the pick-up head 18 and placed in a collecting vessel 40. The latter is arranged directly beside the pallet, and aligned to same. The length of the collecting vessel 40 is somewhat greater than the corresponding measurement of the intermediate layer 17. The latter is led in the region of an upper wall 41 via a transverse slot 42 from above by the pick-up head 18 into the collecting vessel 40. The upper wall 41 here consists of transparent material. The collecting vessel 40 is provided in the region of a wall, namely a narrow side wall 43, with a flap or door 44. This makes possible access to the collecting vessel 40 and the removal of the intermediate layers collected in same.

With a suitable configuration of the pick-up head 18, the described installation can also be used for the handling of stacks of blanks without any band label.

The device described above may be used particularly advantageously in connection with a device corresponding to EP 0 706 946.

What is claimed is:

1. A device for picking up and transporting onwards stacks (10) of blanks arranged one above the other, a plurality of stacks being positioned in rows beside one another on a base (12), with layers (16) of stacks being disposed above one another, and the stacks of blanks (10) being able to be grasped either individually or in groups by a pick-up head (18) and set down on an onward conveyor (14) leading to a packaging machine, said device comprising:

a telescoping member for moving the pick-up head (18) in a horizontal plane, said pick-up head (18) also being movable, along a crossrail (24) extending horizontally, backwards and forwards transversely to a conveying direction of the onward conveyor (14), and also being movable up and down; and in a working region of the pick-up head (18), an interim store (34) for receiving a supply of the stacks (10), and being arranged in such a way that the stacks (10) may be set down by the pick-up head (18) alternatively on the onward conveyor (14) and in the interim store (34);

wherein the interim store (34) has a conveying member to receive the stacks of blanks (10).

2. A device for picking up and transporting onwards stacks (10) of blanks arranged one above the other, a plurality of stacks being positioned in rows beside one another on a base (12), with layers (16) of stacks being disposed above one another, and the stacks of blanks (10) being able to be grasped either individually or in groups by a pick-up head (18) and set down on an onward conveyor (14) leading to a packaging machine, said device comprising:

a telescoping member for moving the pick-up head (18) in a horizontal plane, said pick-up head (18) also being movable, alone a crossrail (24) extending horizontally, backwards and forwards transversely to a conveying direction of the onward conveyor (14), and also being movable up and down;

in a working region of the pick-up head (18), an interim store (34) for receiving a supply of the stacks (10), and being arranged in such a way that the stacks (10) may be set down by the pick-up head (18) alternately on the onward conveyor (14) and in the interim store (34); and in a region of an end of the onward conveyor (14) associated with the pick-up head (18), a lifting member to receive a group of stacks of blanks (10) and to convey same to the interim store (34) or to the onward conveyor (14).

3. The device according to claim 2, wherein the lifting member is a lifting conveyor (38) which has a conveying member to convey the stacks of blanks (10) in one or another direction, respectively, as the stacks of blanks (10) are received and conveyed.

4. A device for receiving and transporting stacks (10) of blanks arranged on top of one another, a plurality of stacks (10) of blanks being positioned next to each other in rows (13) of stacks on a supporting surface (12), said device comprising:

a) a pick-up head (18) for gripping at least one of the stacks (10) of blanks, and for setting the stacks (10) down on a discharge conveyor (14) leading to a packaging machine;

b) a support structure (19) on which the pick-up head (18) is movably mounted, and which includes a plurality of upright posts (20, 21, 22) and an upper, horizontal crossrail (24) coupled to the posts;

c) a downward directed, vertical telescopic member (25), coupled to said upper crossrail (24), which is displaceable in the horizontal direction thereof along the crossrail (24), and which has at a lower end thereof a carrying device (28) which is movable up and down by said vertical telescopic member; and d) a horizontal telescopic member (29) which is carried by the carrying device (28), and at an end of which said pick-up head (18) is disposed, e) wherein the horizontal telescopic member (29) extends horizontally in, a transverse direction to the crossrail (24), in such a manner that the pick-up head is movable back and forth in said transverse direction by said horizontal telescopic member (29).

5. The device according to claim 4, wherein the pick-up head (18) is supported on a load-bearing framework (19) which comprises:

two upright posts (20, 21) connected to each other by a transverse bar (23) next to the supporting surface (12); and opposite said two posts (20, 21), a single post (22) next to said conveyor (14), said crossrail (24) extending from said single post (22) above said conveyor (14) and said supporting surface (12), and being connected to said transverse bar (23) of the two posts (20, 21).

6. The device according to claim 4, wherein said vertical telescopic member (25) is displaceably attached to the underside of the upper crossrail (24), and wherein the vertical telescopic member (25) comprises:

an upper supporting section (26) that is movable on the upper crossrail (24); and a lower supporting section (27) which is movable up and down, and which is attached to the upper supporting section (26) for mounting said carrying device (28).

7. The device according to claim 4, further comprising an elongated carrying arm (45) for the pick-up head (18), wherein said horizontal telescopic member (29) for moving the pick-up head (18) is connected to the carrying device (28) in a horizontal plane, said elongated carrying arm (45) being configured to slide on said carrying device (28).

8. The device according to claim 7, wherein said pick-up head (18) is displaceable on said elongated carrying arm (45) in the longitudinal direction thereof.

9. The device according to claim 4, wherein said pick-up head (18) is capable of simultaneously receiving a plurality of said stacks (10) lying next to each other, in such a way that the stacks (10) are arranged at the pick-up head (18) in a formation corresponding to their relative positions on the discharge conveyor (14).

10. The device according to claim 4, further comprising an intermediate store (34), located in a working area of the pick-up head (18), for receiving a supply of the stacks (10), so that the pick-up head (18) can set down the stacks (10) alternatively on said discharge conveyor (14) and in the intermediate store (34).

11. The device according to claim 10, wherein the intermediate store (34) has a bidirectional conveying element for receiving the stacks (10) of blanks.

12. The device according to claim 11, further comprising, located at an end of the discharge conveyor (14), a lifting member (38) for receiving groups of the stacks (10), and for alternatively conveying the groups to said intermediate store (34) and to the discharge conveyor (14).

13. The device according to claim 12, wherein the lifting element for the stacks (10) is a lifting conveyor (38) which has a conveying element for conveying the stacks (10) in one and another direction, respectively, when receiving and discharging the stacks (10).

14. The device according to claim 4, further comprising, located adjacent to the supporting surface (12), a collecting vessel (40) for receiving thin ply layers (17) arranged between adjacent layers (16) of the stacks (10), the collecting vessel (40) having on a top side thereof a slit (42) through which the ply layers (17) are introduced by the pick-up head (18).

15. The device according to claim 4, wherein each stack (10) is surrounded by a band strip (11), and wherein the pick-up head (18) has suction members (33) for gripping the stacks (10) on a top side thereof.

16. The device according to claim 4, wherein the pick-up head (18) is positionable in a region below the upper crossrail (24).

17. The device according to claim 4, wherein the pick-up head (18) is positionable on both sides of and below the upper crossrail (24).

18. The device according to claim 4, wherein the vertical telescopic member (25) with the pick-up head (18) is arranged above the discharge conveyor (14) and is positionable parallel thereto.

19. The device according to claim 4, wherein the supporting surface (12) is positioned below the upper crossrail (24) and between said upright posts (20, 21, 22).

20. The device according to claim 4, wherein the discharge conveyor (14) runs perpendicular to and underneath the upper crossrail (24).

21. A device for receiving and transporting stacks (10) of blanks arranged on top of one another, a plurality of stacks (10) of blanks being positioned next to each other in rows (13) of stacks on a supporting surface (12), said device comprising:

a) a pick-up head (18) for gripping at least one of the stacks (10) of blanks, and for setting the stacks (10) down on a discharge conveyor (14) leading to a packaging machine;

b) an intermediate store (34), located in a working area of the pick-up head (18), for receiving a supply of the stacks (10) of blanks, so that the pick-up head (18) can set down the stacks (10) alternatively on the discharge conveyor (14) and in the intermediate store (34); and c) located at an end of the discharge conveyor (14), a lifting member (38) for receiving a groups of the stacks (10) and for alternatively conveying the groups to the intermediate store (34) and therefrom to the discharge conveyor (14).

22. The device according to claim 21, wherein said lifting element is a lifting conveyor (38) which has a conveying element for conveying the stacks (10) in one and another direction, respectively, when receiving and discharging the stacks (10).

23. The device according to claim 21, wherein said intermediate store (34) has a bidirectionally drivable conveying element for receiving the stacks (10) of blanks.

* * * * *